US009212509B2

(12) United States Patent
Pettengill et al.

(10) Patent No.: US 9,212,509 B2
(45) Date of Patent: Dec. 15, 2015

(54) LOCKING MECHANISM

(71) Applicant: Kiekert AG, Heiligenhaus (DE)

(72) Inventors: Robert S. Pettengill, Farmington, MI (US); Keith Julien, Canton, MI (US); Robert Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 313 days.

(21) Appl. No.: 13/851,524

(22) Filed: Mar. 27, 2013

(65) Prior Publication Data

US 2014/0291998 A1 Oct. 2, 2014

(51) Int. Cl.

| | |
|---|---|
| ***E05C 3/06*** | (2006.01) |
| ***E05C 3/12*** | (2006.01) |
| ***E05B 85/00*** | (2014.01) |
| ***E05B 85/26*** | (2014.01) |
| *E05C 3/16* | (2006.01) |

(52) U.S. Cl.

CPC . *E05C 3/12* (2013.01); *E05B 85/00* (2013.01); *E05B 85/26* (2013.01); *Y10T 292/0945* (2015.04)

(58) Field of Classification Search

CPC ..... E05C 3/12
USPC ..... 292/216, DIG. 23
See application file for complete search history.

(56) References Cited

U.S. PATENT DOCUMENTS

| | | | | | |
|---|---|---|---|---|---|
| 4,203,621 | A * | 5/1980 | Noel et al. | ..... | 292/216 |
| 4,691,949 | A * | 9/1987 | Grantz et al. | ..... | 292/216 |
| 4,783,102 | A * | 11/1988 | Bernard | ..... | 292/216 |
| 6,540,271 | B1 * | 4/2003 | Kalsi | ..... | 292/216 |
| 6,540,272 | B2 * | 4/2003 | Spurr | ..... | 292/216 |
| 6,601,883 | B1 * | 8/2003 | Kalsi | ..... | 292/216 |
| 6,773,042 | B2 * | 8/2004 | Spurr et al. | ..... | 292/216 |
| 7,475,923 | B2 * | 1/2009 | Ottino et al. | ..... | 292/216 |
| 7,810,853 | B2 * | 10/2010 | Margheritti | ..... | 292/216 |
| 8,235,428 | B2 * | 8/2012 | Hunt et al. | ..... | 292/216 |
| 8,398,128 | B2 * | 3/2013 | Arabia et al. | ..... | 292/216 |
| 8,827,329 | B2 * | 9/2014 | Scholz et al. | ..... | 292/216 |

FOREIGN PATENT DOCUMENTS

| | | | | |
|---|---|---|---|---|
| DE | 102007003948 | A1 * | 5/2008 | ..... E05B 65/32 |
| DE | 102008061524 | A1 * | 6/2010 | ..... E05B 65/32 |
| DE | 102009026921 | A1 * | 12/2010 | |
| DE | 102009029674 | A1 * | 1/2011 | |
| DE | 102013209599 | A1 * | 11/2014 | |
| WO | WO 2012107024 | A2 * | 8/2012 | |

* cited by examiner

*Primary Examiner* — Carlos Lugo
(74) *Attorney, Agent, or Firm* — Renner, Otto, Boisselle & Sklar, LLP

(57) ABSTRACT

A lock mechanism (1) for a motor vehicle lock (2) comprising a rotary catch (6), a pawl (9) for positive locking the catch (6) in a preliminary-closed stop position (8) as well as in a fully-closed stop position (7), and a blocking lever (14) for blocking the pawl (9) when the pawl (9) is in its preliminary-closed position (8) as well as in its fully-closed stop position (7).

11 Claims, 5 Drawing Sheets

LOCKING MECHANISM

The present invention relates to a locking mechanism for a motor vehicle lock comprising at least a rotary catch, a pawl, and a blocking lever. Such motor vehicle locks are used for motor vehicles, in particular for locking of doors, tailgates, or similar.

BACKGROUND

Known lock units, as described in DE 10 2007 003 948 A1, consist of a rotary catch, a first pawl with a pawl rotation axis, and a blocking lever, where in the locked position the catch transfers a pivoting moment onto the first pawl, which is fixed by the blocking lever. In that, the catch transfers an opening moment onto the pawl. Furthermore, a second pawl is provided, which is mounted to the pawl rotation axis and which may be engaged with the pawl via a blocking lever. In this embodiment the first pawl forms a so-called fully-closed stop pawl, the second pawl forms a so-called preliminary-closed stop pawl. Usually, the lock unit is at the same time activated through a second pawl which during the opening process normally deviates the blocking lever so that the catch on its own pushes away the first pawl as soon as the blockage is released.

From DE 10 2008 061 524 A1, a lock unit of the generic kind is known, which consists of a spring loaded catch, a pawl, and a blocking lever for the pawl, with an opening moment towards the catch, so that the lock positions fully-closed stop and preliminary-closed stop may be accomplished by means of only one pawl with a blocking lever. Consequently, there is no need for a second pawl.

The lock unit according to DE 10 2009 029 674 A1 also does without a second pawl and in addition is designed in a way that it blocked the pawl in preliminary-closed stop as well as in fully-closed stop, however, without a positive locking of the catch and the pawl in both positions. Such lock units have already been produced in high quality and serial production and have proved particularly with regard to operational comfort and noise development.

SUMMARY

The present invention presents a locking mechanism for a motor vehicle lock which consists of few components only and at the same time guarantees high operational safety along with small operating force.

More particularly, the present invention provides a lock mechanism for a motor vehicle lock comprising a rotary catch, a pawl for positive locking the catch in a preliminary-closed stop position as well as in a fully-closed stop position, and a blocking lever for blocking the pawl, when the pawl is in its preliminary-closed position as well as in its fully-closed stop position.

In a preferred embodiment of the invention the blocking lever is designed so that it can overtravel the pawl from its preliminary-closed stop position as well as from its fully-closed stop position.

In a further embodiment the lock mechanism for a motor vehicle lock comprising a rotary catch, a pawl for positive locking the catch in a stop position and a blocking lever for blocking the pawl when the pawl is in its preliminary stop position and in its fully-closed stop position, wherein the blocking lever is designed so that it can overtravel the pawl from both the preliminary-closed stop position and the fully-closed stop position.

In a further preferred embodiment of the invention the pawl has two lever arms, arranged in opposite directions to a pawl rotational axis, with a pawl detent arm with a detent surface and a blocking surface, and with a pawl driving arm.

Also, the lock mechanism according to the invention comprising a blocking lever with two lever arms which preferably are arranged in opposite directions to a blocking lever rotation axis, wherein one lever arm acts as blocking lever release arm with a pawl driver arm, and wherein the lever arm possesses a blocking arm with a blocking surface for the pawl, and a pawl driver arm.

In one embodiment of the invention the blocking lever is blocking the pawl via the blocking arm in pawl fully-closed position as well as in pawl preliminary-closed position when the blocking arm surface contacts the blocking surface of the pawl in pawl opening direction.

In a further preferred embodiment the locking mechanism shows, that the blocking lever ensures that the pawl is completely released from the preliminary-closed position as well as from the fully-closed stop position by means of the release driver arm rising from the blocking lever release arm In an embodiment, the lock mechanism may also be designed so that the blocking lever when releasing the pawl is driven by a lock release lever connected to the door or hatch opening mechanism or by the rotary catch via the blocking lever driving arm.

In an other embodiment the lock mechanism is designed so, that the blocking lever when releasing the pawl is driven by the blocking lever driving arm via a recess in the catch.

In a further embodiment of the invention, the pawl and the blocking lever are both spring-preloaded in clockwise direction.

A further embodiment of the invention shows, that the rotary catch consists of two segments which form the lock bolt inlet, with one segment acting as preliminary-closed stop), and the second segment acting as fully-closed stop, where the stops are beveled and provided with self-opening moments.

In particularly, the invention relates to a motor vehicle lock with a lock mechanism for securing of a motor vehicle door.

Such vehicle locks are regularly used to secure hatches, i.e. vehicle doors or tailgates. The motor vehicle lock is normally mounted in or at a motor vehicle hatch or door. The lock bolt, interacting with the motor vehicle lock of the hatch, is normally mounted to the car body. However, a reversed array of the motor vehicle lock and the lock holder may be possible and in accordance with the invention.

The present invention enables the provision of a low-noise locking mechanism for a motor vehicle lock that may be opened without much effort, and which at the same time guarantees high operational safety. The locking areas of the fully-closed stop and the preliminary-closed stop are beveled in a way which allows the self-opening of the lock unit after the catch has been blocked into the fully-closed stop and the preliminary-closed stop. Consequently, the invention provides a self-opening locking mechanism unit. Especially caused by pressure in the door seals the rotary catch normally exerts a certain pressure on the pawl, this pressure causing the pawl to be pressed out of the stop position. In order to block locks of this kind a blocking lever is needed to stop the pawl that in locked position is tending to open. The blocking lever may be released with relatively low force. Afterwards the lock unit basically opens on its own.

Moreover, the invention enables the provision of a locking mechanism for a motor vehicle lock is provided that with the positive locking of the catch and the pawl ensures the secure blocking of the pawl by the blocking lever in preliminary-closed stop as well as in fully-closed stop position. That means, even if in the closing process the respective door or hatch does not reach the fully-closed position, interlocking will be secured by the blocking lever.

Additionally, in both stop positions a secure gliding of the pawl can be guaranteed. This is achieved with by the so-called overtravel of the pawl opening movement, in fully closed stop position through a driver in the blocking lever that is activated through the door opening chain, in preliminary stop position through the rotary catch. As used herein, overtravel means driving the pawl via a driver until the respective interlocking is completely and securely deactivated.

The blocking lever not only can guarantee secure interlocking of the lock in both the preliminary-closed stop and the fully-closed stop position, but due to the overtravel can also guarantee the secure releasing of the pawl out of both positions. In case of the fully-closed stop position the blocking lever will be driven by the lock release mechanism caused by the door handle, in case of the preliminary-closed stop the lever will be driven by the pawl.

Thus, the lock provides for highly reliable closing of doors or hatches. It is advantageous that this locking mechanism is composed of few parts only and does not need two pawls. Thus, costs are reduced and less space for mounting the lock is needed. The lock unit may be produced at low material cost.

Further advantageous embodiments of the invention are presented by combining features of the appended claims in any technologically sensible manner, thus defining further embodiments of the invention. In addition, characteristics presented in the claims are further specified and explained in the descriptions, and further preferred embodiments of the invention will be illustrated.

BRIEF DESCRIPTION OF THE DRAWINGS

The invention as well as the technical surrounding field will be further explained with the below figures. The figures show special embodiments; the invention is not limited to these figures.

DETAILED DESCRIPTION

Figure 1:
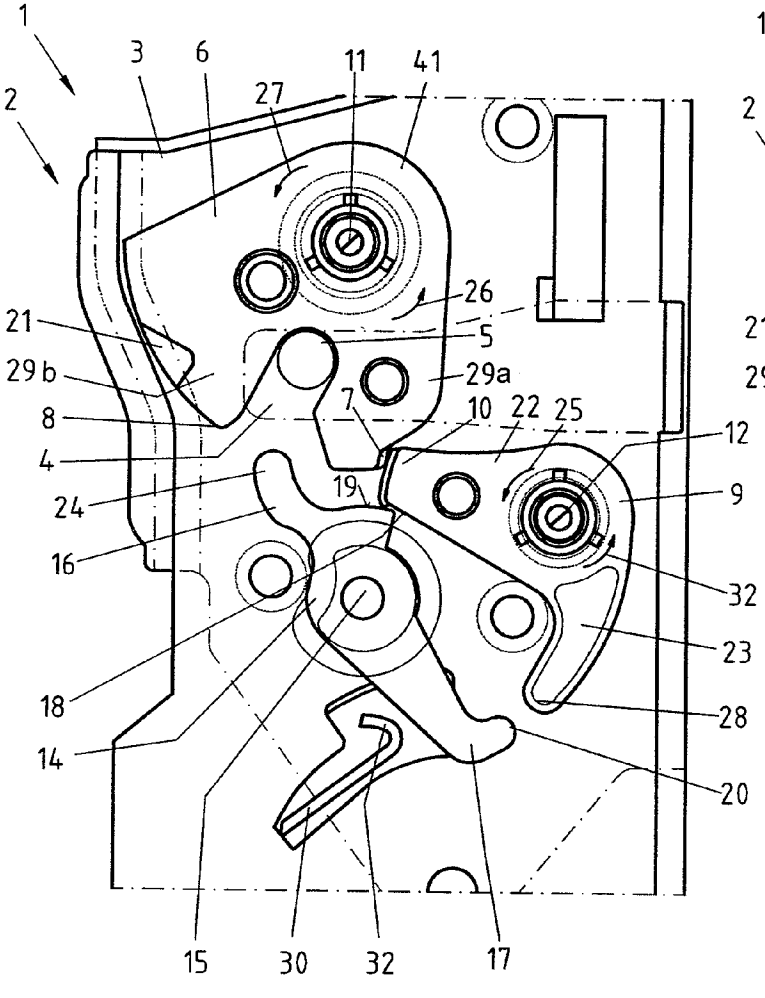
FIG. 1: A motor vehicle lock in locked position

FIG. 1 shows a locking mechanism 1 according to the invention for a motor vehicle lock 2 in fully closed position 41; with a lock unit 2 comprising a catch 6 and a pawl 9 being fixed to a lock plate 3, a lock bolt 5 fixed to the motor vehicle enters the inlet 4 of the catch 6 and will be secured by the locking of the catch 6 and the pawl 9. In this fully closed position 41 of the motor vehicle lock 2 the catch bolt 5 sits in the inlet 4 of the rotary catch 6. The rotary catch 6 is rotatably mounted to the catch rotation axis 11, so that the rotary catch 6 can make an opening movement 27 (here in counter-clockwise direction) and a closing movement 26 (here in clockwise direction) from the fully-closed position 41 and the opening position 42 (see FIG. 4). The rotary catch 6 further shows two segments 29*a* and 29*b*; one segment 29*a* is movable to a fully-closed stop position 7 and the second segment 29*b* is movable to a preliminary-closed stop position 8. The segments 29*a* and 29*b* limit the area of the inlet 4 of the rotary catch 6, through which the lock bolt 5 can travel in and out of the rotary catch 6 through the inlet 4. In the range of the fully closed stop 7 the rotary catch 6 interlocks with the pawl 9 which is in fully closed-stop position 28 via the pawl detent arm 22. The fully closed stop 7 of the rotary catch 6 has a blocking surface with a beveling so that if the blocking lever 14 with its blocking surface 19 did not abut against the pawl 9 the lock would open from the fully-closed stop position 7 on its own. Consequently, the FIG. 1 shows a so-called self-opening lock in fully-closed position 7, it means a lock with a self-opening moment. Thus an opening movement 27 of the rotary catch 6 towards the opening position 42 (see FIG. 4) is prevented. The pawl 9 further shows a pawl rotation axis 12, onto which the pawl 9 is rotary mounted in opening 25 and in closing direction 32. Furthermore, the pawl 9 has a pawl drive arm 23 on the far side of the catch for pivoting of the catch 9 into the opening direction 25. The blocking lever 14 has two lever arms 16, 17, which preferably arranged in opposite direction to the blocking lever axis 15, with one lever arm 17 acting as drive lever 17 with a release arm driver 20, the other lever arm 16 being equipped with a pawl blocking arm 19 with a blocking area 19 and a catch-driven (6) blocking lever driving arm 24. Both the pawl 9 as well as the blocking lever 14 are spring-preloaded in clockwise direction.

Figure 2:
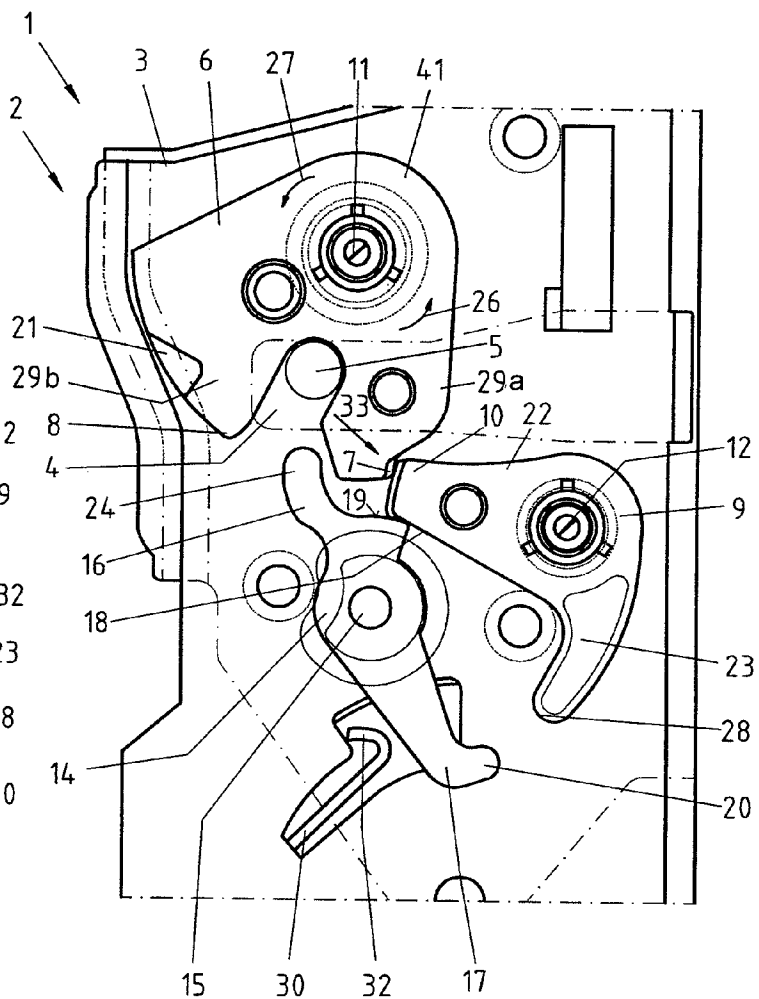
FIG. 2: The motor vehicle lock before opening

FIG. 2 shows the motor vehicle lock 2 at the beginning of the opening movement 27 of the catch 6. It is obvious that when the lock release lever 30 is activated (by a not shown inner or outer door handle), its end part being designed as bent spring 32, pushes against the blocking lever release arm 17 of the blocking lever 14, this moves the blocking lever 14 in counter-clockwise direction, and the blocking surface 19 disengages from the pawl 9, and caused by the beveling of the fully closed stop 7 the pawl 9 moves towards opening. Simultaneously, the catch bolt 5 exerts a first force 33, which might for example result from pressed door seals, on the catch 6. The catch 6 will then be triggered into an opening movement 27. At the same time it becomes obvious that due to the deviation of the blocking lever 14 the release arm driver 20 of the blocking lever release arm 17 is turned into the direction of the pawl driving arm 23. Thus, according to the invention a so-called overtravel of pawl 9 guarantees that the pawl 9 glides from the catch 6 safely and with low noise.

Figure 3:
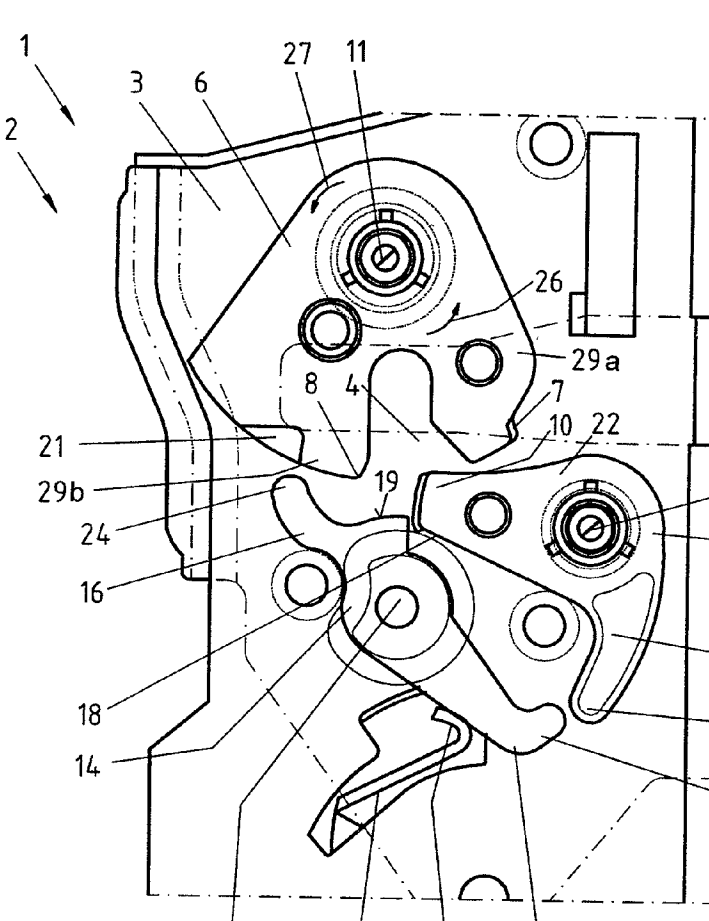
FIG. 3: The motor vehicle lock with the catch in opening movement

FIG. 3 shows that the pawl 9 has now completely left the fully-closed stop position 28 of the rotary catch 6, and the catch 6 is moving spring-supported into the opening direction 27. FIG. 3 further shows that because of the interaction with the release arm driver 20 with the pawl driving arm 23 the pawl 9 does not block the rotary catch 6 in opening direction 27

Figure 4:
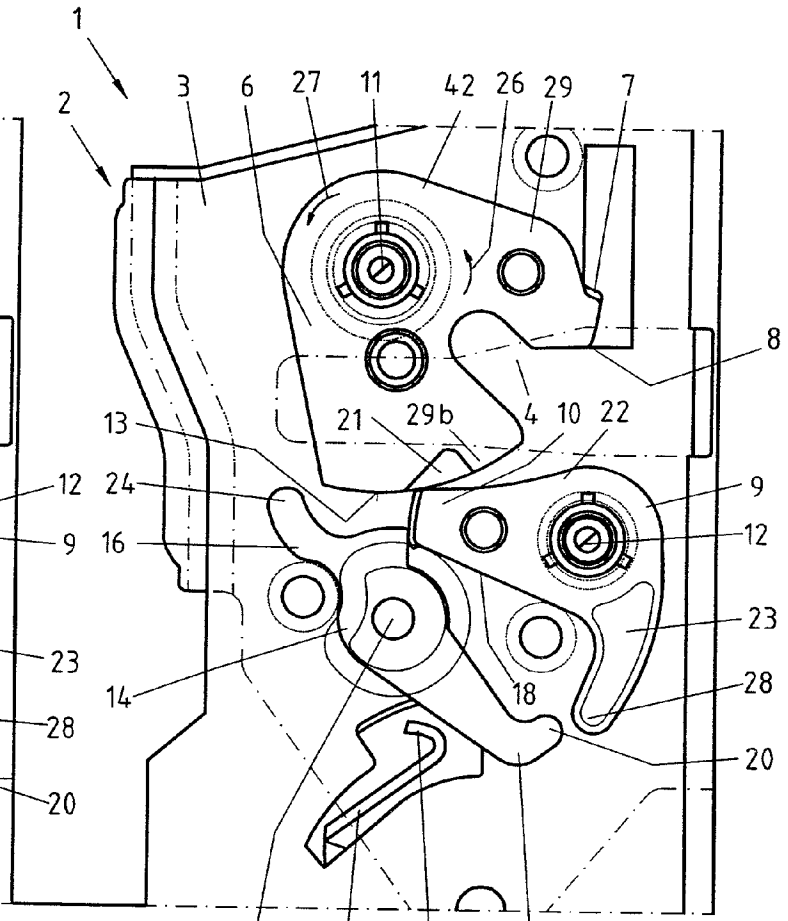
FIG. 4: The motor vehicle lock in opened position

FIG. 4 shows the motor vehicle lock 2 in opening position 42. In this opening position 42, the opening movement 27 of the rotary catch 6 is completed. The blocking lever 16 and the pawl 9 with its pawl detent arm 22 both abut against the rim 13 of the catch 6.

Figure 5:
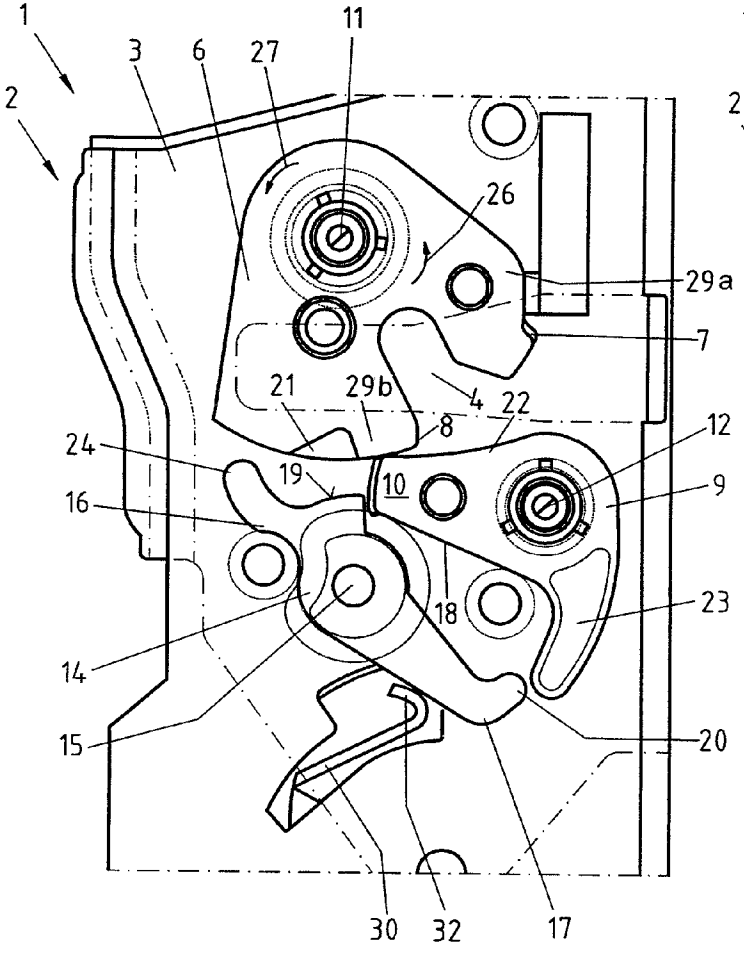
FIG. 5: The motor vehicle lock after leaving the opened position

FIG. 5 shows the motor vehicle lock 2 after leaving the opening position 42. The catch bolt 5 (not shown) has inserted into the inlet 4 after the door or hatch of the motor vehicle has been closed, and has already moved the rotary catch 6 into closing direction 26. Rotary catch 6 and blocking lever 14 keep abutting against the catch rim 13.

Figure 6:
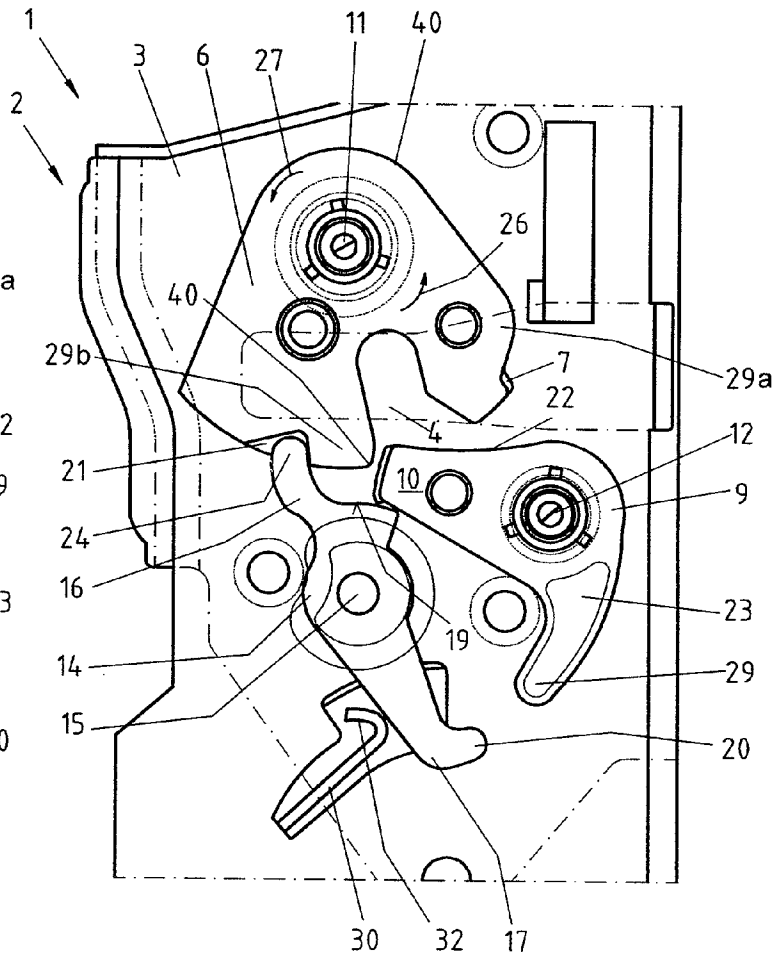
FIG. 6: The motor vehicle lock before the preliminary closed position

FIG. 6 shows the motor vehicle lock 2 in preliminary-closed position. 40. In this preliminary closed position 40 the in clock-wise direction spring-loaded pawl 9 has inserted in position 29 into the rotary catch 6 in preliminary-closed stop position 8 after reaching the preliminary-closed position 40. The also clock-wise spring-loaded blocking lever 14 simultaneously inserted with the blocking arm surface 16 into the recess 21 of the rotary catch 6 and blocks the catch 6 also in preliminary-closed position 40.

Even if a door or hatch of a motor vehicle 31 does not reach the fully-closed position 41 of the lock, locking of the pawl 9 is obtained by the blocking lever 14. The blocking lever drive arm 24 of the blocking lever 14 has inserted in only a part of the thickness of the catch 6 recess 21.

Figure 7:
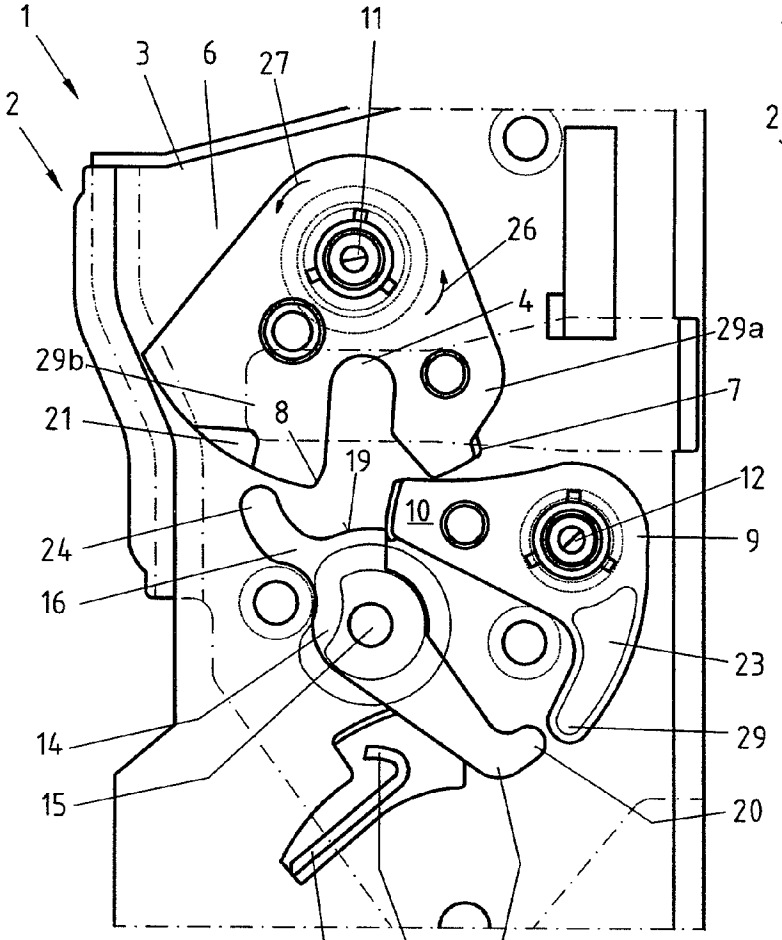
FIG. 7: The motor vehicle lock after leaving the preliminary closed position

FIG. 7 shows the motor vehicle lock 2 shortly after having left the preliminary-closed stop position 8 the catch 6, where the preliminary-closed stop position 8 is also equipped with a beveling forming an opening moment; the secure leaving of the locked position through additional retraction of pawl 9 is obtained. The release arm driver 20 of the blocking lever 14 is actuated not by the lock release lever 30 but by the blocking lever driving arm 24 driven by the catch 6 in the catch recess 21. Thus, also in lock preliminary-closed position 40 according to the invention a so-called overtravel of pawl 9 guarantees that the pawl 9 glides from the catch 6 safely and with low noise.

Figure 8:
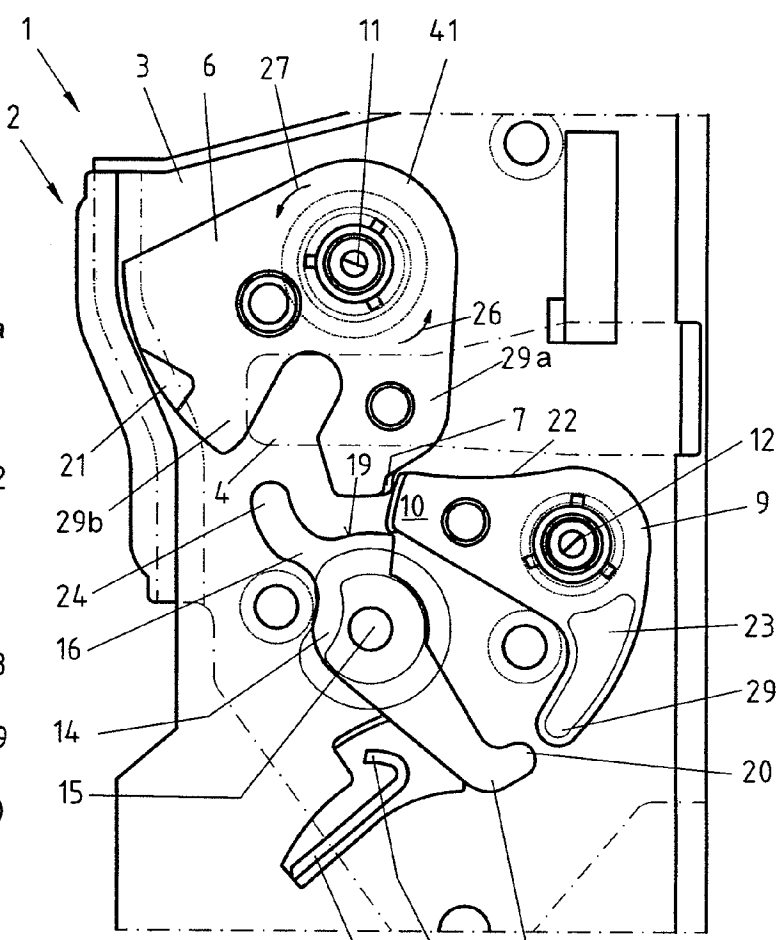
FIG. 8: A motor vehicle lock before the locked position

FIG. 8 shows a motor vehicle lock shortly before the locked position 41 which is shown in FIG. 1.

Figure 9:
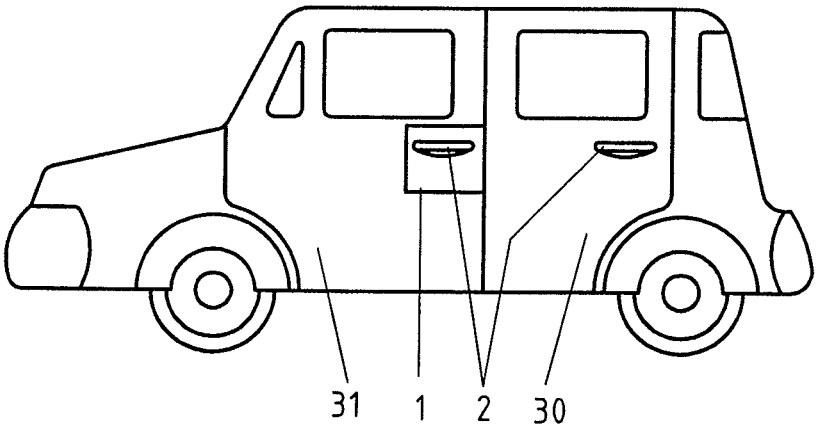
FIG. 9: A motor vehicle with motor vehicle lock

FIG. 9 shows a simplified view of a motor vehicle of a motor vehicle 31. The motor vehicle doors 30 are equipped with a motor vehicle lock mechanism 2 according to the invention.

INDEX OF REFERENCES NUMBERS

1. Locking mechanism
2. Motor vehicle lock
3. Lock plate
4. Lock bolt inlet
5. Lock bolt
6. Rotary catch
7. Fully-closed stop
8. Preliminary-closed stop
9. Pawl
10. Pawl detent surface
11. Catch rotation axis
12. Pawl rotation axis
13. Catch rim
14. Blocking lever
15. Blocking lever rotation axis
16. Blocking arm
17. Blocking lever release arm
18. Catch blocking surface
19. Blocking arm with blocking arm surface
20. Release arm driver
21. Catch recess
22. Pawl detent arm
23. Pawl driving arm
24. Blocking lever driving arm
25. Opening direction pawl
26. Closing direction catch
27. Opening direction catch
28. Fully closed-position pawl
29. Preliminary-closed position pawl
30. Lock release lever
31. Motor vehicle
32. Closing direction catch
33. Catch bolt force from door seal
40. Lock—preliminary-closed position
41. Lock—fully-closed position
42. Lock—opening position

What is claimed is:

1. Lock mechanism for a motor vehicle lock comprising a rotary catch, a pawl for positive locking the catch in a preliminary-closed stop position as well as in a fully-closed stop position, and a blocking lever for blocking the pawl when the pawl is in its preliminary-closed position as well as in its fully-closed stop position;

wherein the blocking lever has two lever arms which are arranged in opposite directions to a blocking lever rotation axis, wherein one lever arm acts as a blocking lever release arm with a pawl driver arm, and the other lever arm possesses a blocking arm with a blocking surface for the pawl.

2. Lock mechanism according to claim 1, further comprising a release lever that is activated to move the blocking lever from blocking the pawl in the preliminary-closed stop position and fully-closed stop position, wherein the blocking lever is designed so that it can overtravel the pawl from its preliminary-closed stop position as well as from its fully-closed stop position when the release lever is activated.

3. Locking mechanism according to claim 1, wherein the blocking lever, is blocking the pawl via the blocking arm in pawl fully-closed position as well as in pawl preliminary-closed position when the blocking arm surface contacts the blocking surface of the pawl in pawl opening direction.

4. Locking mechanism according to claim 1, wherein the blocking lever ensures that the pawl is completely released from the preliminary-closed position as well as from the fully-closed stop position by means of the release driver arm rising from the blocking lever release arm.

5. Lock mechanism according to claim 4, wherein the blocking lever when releasing the pawl is driven by a lock release lever connected to the door or hatch opening mechanism or by the rotary catch via the blocking lever driving arm.

6. Lock mechanism according to claim 4, wherein the blocking lever when releasing the pawl is driven by the blocking lever driving arm via a recess in the catch.

7. Lock mechanism according to claim 1, wherein the pawl and the blocking lever are both spring-preloaded in clockwise direction.

8. Lock mechanism according to claim 1, wherein the rotary catch consists of two segments which form the lock bolt inlet, with one segment acting as preliminary-closed stop, and the second segment acting as fully-closed stop, where the stops are bevelled and provided with self-opening moments.

9. Motor vehicle showing a motor vehicle lock with a lock mechanism according to claim 1 for securing of a motor vehicle door.

10. Lock mechanism for a motor vehicle lock comprising a rotary catch, a pawl for positive locking the catch in a stop position, a blocking lever for blocking the pawl when the pawl is in its preliminary stop position and in its fully-closed stop position, and a release lever that is activated to move the blocking lever from blocking the pawl in the preliminary-closed stop position and fully-closed stop position, wherein the blocking lever is designed so that it can overtravel the pawl from both the preliminary-closed stop position and the fully-closed stop position when the release lever is activated, and wherein the blocking lever has two lever arms which are arranged in opposite directions to a blocking lever rotation axis, wherein one lever arm acts as a blocking lever release arm with a pawl driver arm, and the other lever arm possesses a blocking arm with a blocking surface for the pawl.

11. Lock mechanism according to claim 10, wherein the pawl has two lever arms, arranged in opposite directions to a pawl rotational axis, with a pawl detent arm with a detent surface and a blocking surface, and with a pawl driving arm.

* * * * *